United States Patent [19]

Murata

[11] 3,995,880

[45] Dec. 7, 1976

[54] HEEL PIECE OF A SKI SAFETY BINDING

[75] Inventor: Masahiro Murata, Tokyo, Japan

[73] Assignee: Hope Kabushiki Kaisha, Tokyo, Japan

[22] Filed: Oct. 31, 1975

[21] Appl. No.: 627,797

[30] Foreign Application Priority Data

Oct. 31, 1974 Japan ..... 49-125729
Oct. 31, 1974 Japan ..... 49-125730

[52] U.S. Cl. ..... 280/626; 280/633
[51] Int. Cl.[2] ..... A63C 9/08
[58] Field of Search ..... 280/620, 619, 626, 623, 280/633

[56] References Cited

UNITED STATES PATENTS

| | | | |
|---|---|---|---|
| 3,558,151 | 1/1971 | Payrhammer | 280/619 |
| 3,573,878 | 4/1971 | Marker | 280/619 |
| 3,612,560 | 10/1971 | Payrhammer | 280/619 |
| 3,873,112 | 3/1975 | Covini | 280/620 |

FOREIGN PATENTS OR APPLICATIONS

| | | | |
|---|---|---|---|
| 2,250,956 | 5/1973 | Germany | 280/623 |

*Primary Examiner*—Robert R. Song
*Attorney, Agent, or Firm*—Diller, Brown, Ramik & Wight

[57] ABSTRACT

A heel piece of a ski safety binding which automatically opens when an excessive force is exerted on the ski boot. The heel piece includes a pair of arms pivotally connected to a base plate, a frame pivotally connected to a pivot pin extending between the pair of arms, which frame is displaceable along the axis of the ski, a heel holding member provided at the front end of the frame and a lock piece disposed in the frame and being displaceable along the axis of the ski relative to the frame. The lock piece has a cam surface which engages a lock pin provided between the pair of arms in a normal state of use. When a strong upwardly directed force is applied to the heel holding member as in a case of a forward fall of the skier, the frame and lock piece displace rearwardly and thereby brings the lock pin out of engagement with the cam surface of the lock piece, enabling the heel piece to rotate for releasing the heel of the ski boot. A release load can be adjusted by varying space defined between the frame and the lock piece.

5 Claims, 10 Drawing Figures

HEEL PIECE OF A SKI SAFETY BINDING

The present invention relates to a heel piece of a ski safety binding which is adapted to open automatically when the skier falls forwardly.

A ski safety binding consists of a toe piece for holding the toe portion of a ski boot and a heel piece for holding the heel portion of the ski boot.

Various heel pieces have been proposed and used which comprise a base plate attached fixedly to a ski, a supporting member provided on the base plate, a casing convering the supporting member and being pivotably connected thereto, which has a heel holding member adapted for engaging the heel of the ski boot at the front end thereof and heel holding means which depress the casing toward the base plate at a closed position of the casing thereby pressing the heel firmly on the ski and release the casing upwardly when a strong upwardly directed force occurs.

Most of these prior art heel pieces are extremely complicated in their construction and require a large number of component parts since they must satisfy strict conditions for safe and accurate operations both in normal use and in the event of a forward fall of the skier, and a manufacturing cost of such heel piece tends to become excessively high.

It is, therefore, an object of the present invention to provide a heel piece of a ski safety binding which is of a very simple and compact construction with a minimum possible number of component parts without sacrificing accuracy in operation.

The above and other objects and features of the invention will become apparent from the description made hereinbelow in conjunction with the accompanying drawings in which.

A heel piece A according to the invention has a pair of arms 1, 1′ which are pivotally mounted at their end portion 1*a*, 1′*a* to a base plate 21.

Figure 2:
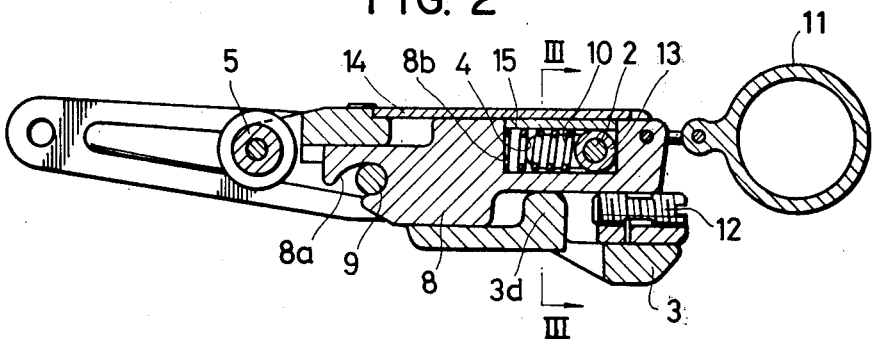
FIG. 2 is a sectional view of the heel piece taken along line II — II′ in FIG. 1.

A pin 2 extending across the axis of the ski is secured at either end thereof to the free end portions of the arms 1, 1′. The pin 2 may have a collar 13 mounted around it. A frame 3 has an opening 4 extending along whole length of the pin 2 and having an elongated cross section in the direction of the axis of the ski as is best seen in FIG. 2. The pin 2 is engaged in this opening 4 and, accordingly, the frame 3 is slidable forwardly and rearwardly along the axis of the ski relative to the pin 2 as well as pivotable about the pin 2. At the foremost end portion of the frame 3 there is provided a suitable heel holding member 5 for holding the ski boot securely when the heel piece is in use. In the present embodiment, a roller rotatably mounted between projections 3*a*, 3*b* provided at the fore end portion of the frame 3 serves as the heel holding member 5.

Elongated openings 6, 6′ which are continuous to the opening 4 at the rear end thereof are formed on either side of the longitudinal axis of the frame 3. Helical springs 7, 7′ are respectively disposed in the openings 6, 6′ in such a manner that with their fore ends abutting against the fore end walls of the opening 6, 6′ and their rear ends extending into the opening 4 and abutting against the pin 2, these springs 7, 7′ will constantly exercise a forwardly acting force to the frame 3. A further opening 3*c* is formed in the control portion of the frame 3 along the axis of the frame and lock piece 8 is disposed in this opening 3*c*. This lock piece 8 is slidable in the opening 3*c* in the direction of the axis of the ski and is formed in its upper central portion with an opening 8*b* which is continuous to the opening 4 and in which a helical spring 10 is disposed with its fore end portion abutting against the fore end wall of the opening 8*b* and its rear end portion abutting against the pin 2. The spring 10 accordingly exercises a forwardly acting force to the lock piece 8. The lock piece 8 is formed in its lower fore end portion with an arcuate notch 8*a*. This notch 8*a* is engageable with a lock pin 9 provided transversely and fixedly between the two arms 1, 1′. In a forwardly displaced position of the lock piece 8(FIGS. 2 and 8), the notch 8*a* engages the lock pin 9 thereby preventing rotation of the lock piece 8 and the frame 3. In a rearwardly displaced position of the lock piece 8 (FIG. 9), the lock pin 9 is brought out of engagement with the notch 8*a* thereby allowing clockwise rotation of the lock piece 8 and the frame 3 as will be described in detail later.

A boot releasing knob 11 is secured to the rear end of the lock piece 8. A release load adjusting screw 12 is threaded in the rear end portion of the lock piece 8 in a direction of the axis of the ski. The fore end of the adjusting screw 12 is disposed in a position opposed to an upward projection 3*d* of the frame 3. Distance of displacement of the frame 3 relative to the lock piece 8 in a case where a rearwardly acting force acts against the frame 3 is determined by the distance between the fore end of the adjusting screw and the rear end wall of the projection 3*d*. Reference numeral 14 designates a cover plate secured on the frame 3 by a suitable fastening device, reference numeral 15 a spacer, and reference numeral 17 designates an opening for inserting a pin for pivotally mounting the arms 1, 1′ to the base plate 21.

Referring to FIGS. 4 through 7, an example of a base plate and means for mounting the heel piece to the base plate will be described. The base plate 21 has four openings 22 for receiving screws used for securing the base plate 21 to the ski. The base plate 21 has bent portions 23, 23′ on either side thereof which constitute guide rails for a slide 26. The base plate 21 has a central opening 21*a* formed in a longitudinal direction of the base plate 21. The portions of the base plate 21 on either side of the opening 21*a* are bent obliquely upwardly to form rails 24, 24′. These rails 24, 24′ are formed with a plurality of notches 25, 25′ having a predetermined interval between each other.

The slide 26 has guide portions 26*a*, 26*a'* on its sides and slidably engages through these guide portions with the base plate 21. A boss 27 is provided at the rear end portion of the slide 26 and an adjusting screw 28 is in threaded engagement with the boss 27. An adjusting lever 29 is rotatably mounted on the head portion of the screw 28. The adjusting lever 29 has cam faces 30, 30' which engage the notches 25, 25' as shown by a solid line in FIG. 7 when the adjusting lever 29 is in a horizontal position. In this position the sliding movement of the slide 26 is prevented. A spring 31 is in abutting engagement with the adjusting lever 29 to impart a pivoting force to the adjusting lever 29 so that the cam faces 30, 30' will not disengage from the notches 25, 25'. The slide 26 has projections 32, 32' each having an opening 33 therein. The end portions 1*a*, 1'*a* of the arms 1, 1' are pivotally mounted to the prejections 32, 32' by means of pins (not shown) which are inserted through the corresponding openings 17 of the arms 1, 1' and openings 33 of the projections 32, 32'.

Figure 7:
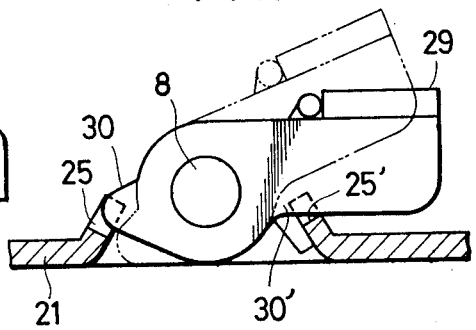
FIG. 7 is a view showing a part of the base plate and the heel piece mounting device in an enlarged scale.

The slide 26 can be displaced in the longitudinal direction of the base plate 21 by rotating the adjusting lever 29 in a counterclockwise direction as viewed in FIG. 7 to a position shown by a chain and dot line in FIG. 7 and thereby disengaging the lever 29 from the notches 25, and 25'. Minute adjustment of the position of the slide 26 can be effected by rotating the adjusting screw 28.

Operation of the heel piece according to the invention will now be described.

Figure 8:
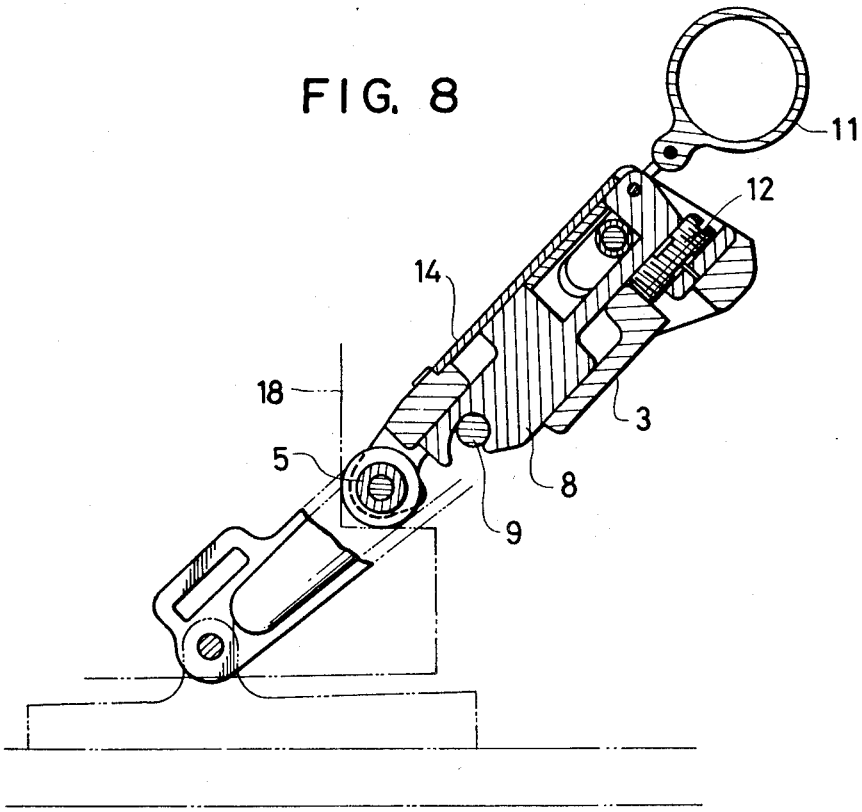
FIGS. 8 and 9 are sectional views of the heel piece for showing operation thereof.

In fitting the heel piece to the ski boot, the wearer of the ski boot first inserts the toe of the ski boot into a toe piece (not shown) of the safety binding. The wearer then lifts up the frame 3 with the lock pin 9 being disengaged from the notch 8*a* of the lock piece 8, places the roller 5 on the sole of the ski boot and further lifts up the frame 3 by the knob 11. Since the roller 5 rests against the heel of the ski boot and is prevented from upward movement, the roller 5, the frame 3, and the lock piece 8 displace rearwardly relative to the pin 2 against the force of the springs 7, 7' until the notch 8*a* comes into snapping engagement with the pin 9. Thus the ski boot is securely placed in the heel piece for normal skiing operations as shown in FIG. 8.

If an upwardly directed force below a predetermined value is applied to the heel portion of the ski boot, the frame 3 is displaced rearwardly against the force of the springs 7, 7' within the distance between the rear end wall of the projection 3*d* and the fore end of the adjusting screw 12. Since the adjusting screw 12 is not pressed by the frame 3, the lock piece 8 remains pressed against the pin 9 and the heel piece continues to hold the ski boot to the ski.

Figure 9:
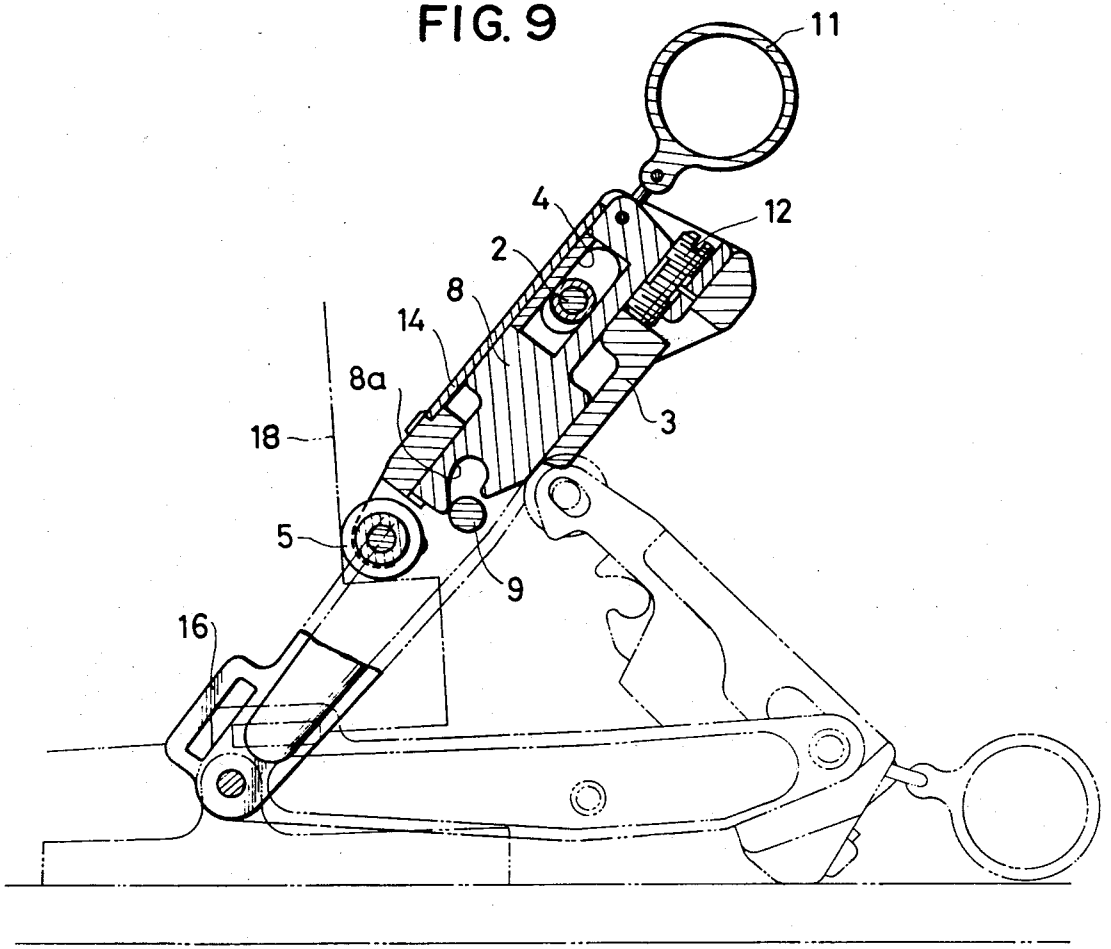

If a dangerous upward force exceeding the predetermined value is applied to the heel portion of the ski boot as in the case of forward fall of the skier, the frame 3 is displaced rearwardly against the force of the springs 7, 7' and the lock pin 9 is disengaged from the notch 8*a* as shown by a solid line in FIG. 9. As a result, the frame 3 and the roller 5 are now capable of rotating about the pin 2 in a clockwise direction as viewed in FIG. 9. The frame 3 accordingly rotate clockwise due to the upward force applied to the ski boot and, as the roller 5 is disengaged from the heel portion of the ski boot, the arms 1, 1' fall downwardly, i.e. rotate in a clockwise direction to a position shown by chain and dot lines in FIG. 9. Thus, the ski boot is released from the heel piece. The magnitude of the releasing load can be determined as desired by suitably selecting the distance between the projection 3*d* and the adjusting screw 12 by turning the adjusting screw 12.

If the wearer of the ski boot desires to release the ski boot from the safety binding, he pulls the boot releasing knob 11 rearwardly. The lock piece 8 is displaced rearwardly against the force of the spring 10 and thereby brings the notch 8*a* out of engagement with the lock pin 9. This allows the frame 3 to be rotated in a clockwise direction and release the ski boot from the heel piece.

In the present embodiment, the roller 5 is used as the most desirable heel holding member. It will be noted, however, that the heel holding member is not limited to the roller but other suitable constructions may be employed within the scope of the invention. For example, the heel holding member may be constituted by a simple projecting portion formed integrally with the frame 3.

Figure 1:
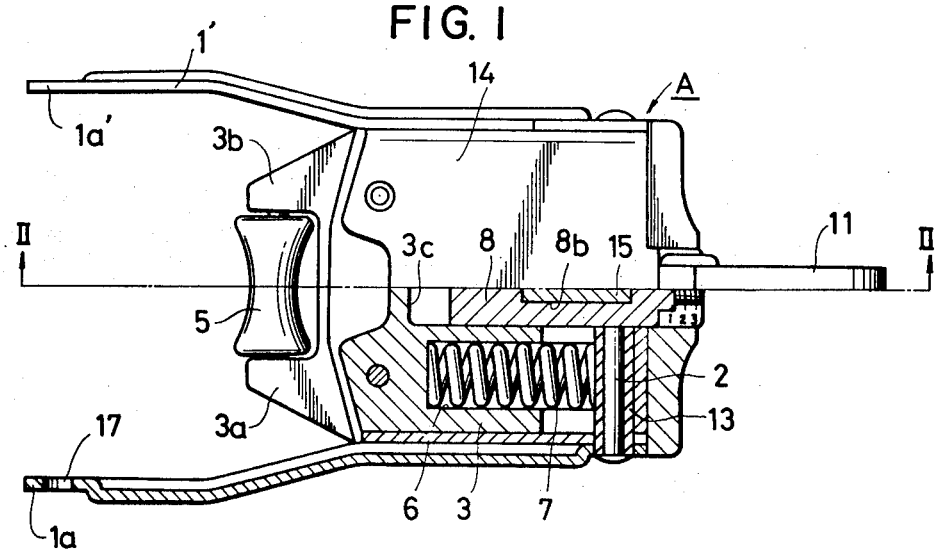
FIG. 1 is a plan view of a preferred embodiment of the heel piece according to the invention, partly in section.
Figure 3:
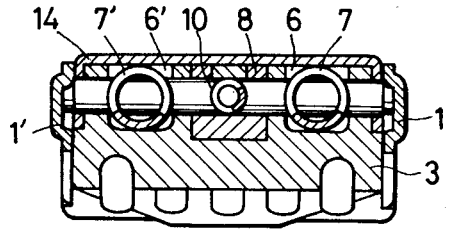
FIG. 3 is a sectional view of the heel piece taken along line III — III′ in FIG. 2.
Figure 4:
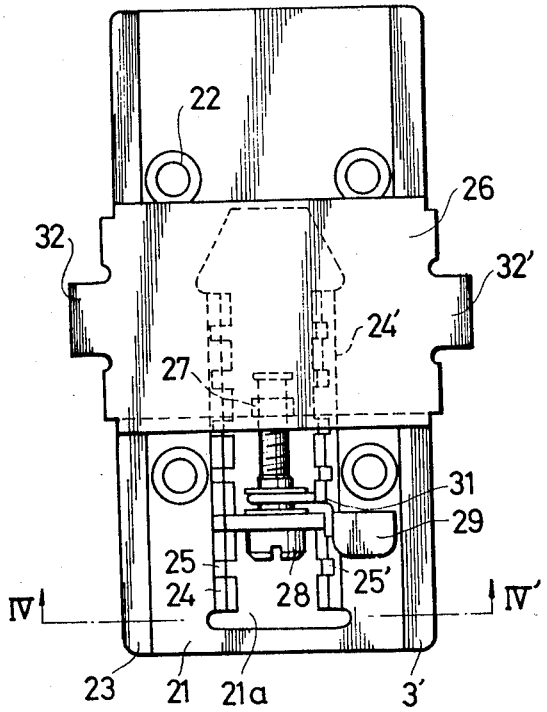
FIG. 4 is a plan view of an example of base plate and heel piece mounting device which are component parts of the heel piece.
Figure 6:
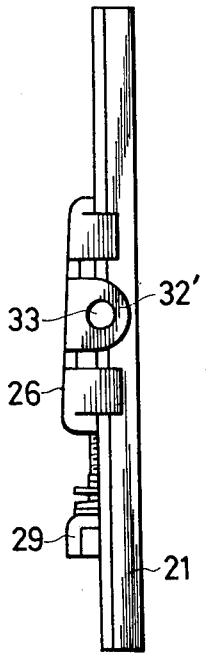
FIG. 6 is a side view of the base plate and the heel piece mounting device.
Figure 5:
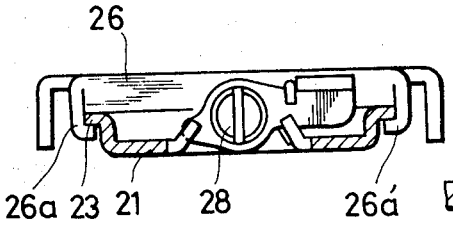
FIG. 5 is a sectional view of the base plate and the heel piece mounting device taken along line IV — IV in FIG. 4.
Figure 10:
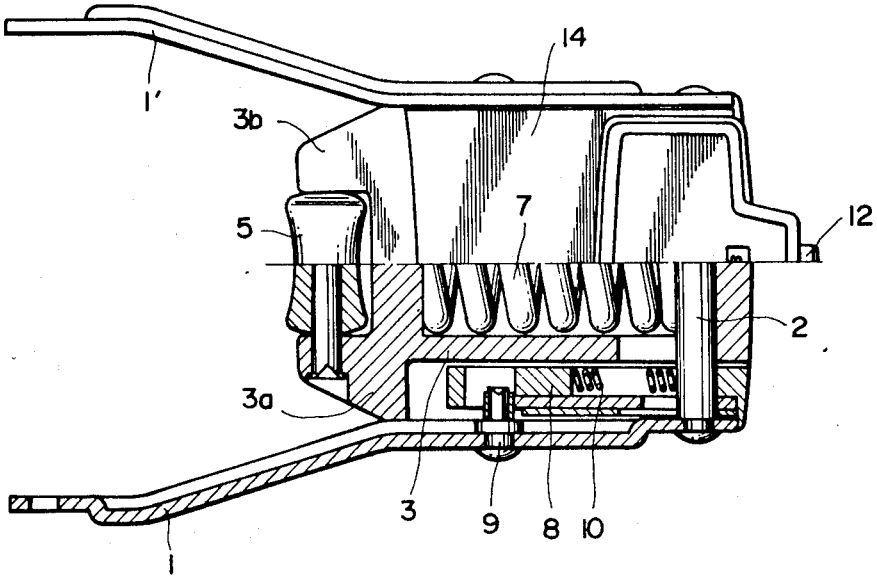
FIG. 10 is a plan view of another embodiment of the heel piece according to the invention partly in section.

Further, in the above described embodiment, the lock piece is disposed in the central portion of the frame and the pair of helical springs 7, 7' are disposed on both sides of the lock piece. The invention is not limited to this particular construction. FIG. 10 shows a modified example of the heel piece according to the invention. In the figure, the same reference numerals appearing in FIGS. 1 through 3 are used to designate the same component parts. It will be noted that a single spring 7 is disposed in the central portion of the frame 3 and a pair of lock pieces 8 are disposed on both sides of the centrally disposed spring 7. It will also be noted that a pair of lock pins 9 are fixedly secured to the arms 1, 1' instead of a single lock pin extending across the axis of the ski in the embodiment shown in FIGS. 1 – 3.

What is claimed is:

1. A heel piece of a ski safety binding comprising:

a base plate attached fixedly to a ski;

heel piece mounting means supported on said base plate and being slidable along the axis of the ski;

a pair of arm pivotally connected to said heel piece mounting means;

a pivot pin provided between the free end portions of said pair of arms and extending horizontally across the axis of the ski;

a frame pivotally connected to said pivot pin and being displaceable along the axis of the ski relative to said pivot pin;

a heel holding member fixedly secured to said frame and adapted for fitting with the heel of a ski boot at the front end thereof;

first spring means provided between said pivot pin and said frame for exercising a forwardly directed force to said frame;

a lock piece provided in said frame and being displaceable along the axis of the ski relative to said pivot pin and said frame;

second spring means provided between said pivot pin and said lock piece for exercising a forwardly directed force to said lock piece;

a cam surface formed in the fore end portion of said lock piece;

a lock pin secured to said pair of arms and being engageable with said cam surface; and a release load adjusting screw provided between said frame and said lock piece.

2. A heel piece of a ski safety binding as defined in claim 1 wherein said heel holding member is a roller provided horizontally across the axis of the ski.

3. A heel piece of a ski safety binding as defined in claim 1 wherein said lock piece is disposed in the central portion of said frame and said first spring means consist of a pair of helical springs disposed on either side of said lock piece.

4. A heel piece of a ski safety binding as defined in claim 1 wherein said first spring means consist of a single helical spring disposed in the central portion of said frame and a pair of said lock pieces are disposed on both sides of said first spring means.

5. A heel piece as defined in claim 1 wherein said heel piece mounting means comprise:

a pair of rails with notches provided on said base plate in a longitudinal firection of said base plate;

a slide slidably engaging said base plate and having the end portions of said pair of arms connected thereto;

an adjusting screw threaded in said slide;

an adjusting lever rotatably connected to said adjusting screw and having cam faces engageable in said notches; and spring means for exercising a rotational force to said adjusting lever to press cam faces to said notches.

* * * * *